US009986889B2

(12) United States Patent
Looney

(10) Patent No.: US 9,986,889 B2
(45) Date of Patent: Jun. 5, 2018

(54) VACUUM-BASED CLEANING APPARATUS AND METHOD

(71) Applicant: Carl Looney, Detroit, MI (US)

(72) Inventor: Carl Looney, Detroit, MI (US)

( * ) Notice: Subject to any disclaimer, the term of this patent is extended or adjusted under 35 U.S.C. 154(b) by 201 days.

(21) Appl. No.: 13/842,485

(22) Filed: Mar. 15, 2013

(65) Prior Publication Data

US 2014/0265092 A1 Sep. 18, 2014

(51) Int. Cl.
*A47L 23/22* (2006.01)
*A47L 9/24* (2006.01)

(52) U.S. Cl.
CPC ..... *A47L 23/22* (2013.01); *A47L 9/242* (2013.01)

(58) Field of Classification Search
CPC ..... A47L 7/0047; A47L 23/263; A47L 23/22; A47L 9/242; B25B 11/005; G03B 27/60; B65G 47/91
USPC ..... 15/161, 310
See application file for complete search history.

(56) References Cited

U.S. PATENT DOCUMENTS 3,165,773 A * 1/1965 Palpacelli ..... 15/310
3,610,270 A * 10/1971 Attie ..... 137/362
3,649,994 A * 3/1972 Harris ..... A47L 23/263 15/311
3,786,531 A * 1/1974 Borg ..... 15/310
3,809,073 A * 5/1974 Baumann ..... 601/168
4,027,355 A * 6/1977 Mead et al. ..... 15/310
5,870,797 A * 2/1999 Anderson ..... 15/301
2002/0178528 A1* 12/2002 Koch ..... 15/310
2006/0021994 A1* 2/2006 Masuda ..... 222/92
2006/0231995 A1* 10/2006 Wang ..... B25B 11/005 269/21
2007/0271723 A1* 11/2007 Junell ..... 15/310
2010/0011962 A1* 1/2010 Totsugi ..... 96/400

FOREIGN PATENT DOCUMENTS

FR 2108848 A7 * 5/1972

* cited by examiner

*Primary Examiner* — Christopher M Koehler
*Assistant Examiner* — Joel Crandall

(57) ABSTRACT

An apparatus and method for cleaning. The original motivation for the creation of the apparatus was the cleaning of shoes or bare feet, but the apparatus can be used in other organic and inorganic applications as well. The apparatus can be used in conjunction with a variety of different vacuum technologies, including wet dry vacuum systems. The apparatus can be implemented as a stand-alone mat or as modular component that can be combined with other units to achieve the desired coverage area.

18 Claims, 21 Drawing Sheets

VACUUM-BASED CLEANING APPARATUS AND METHOD

BACKGROUND OF THE INVENTION

The invention relates generally to apparatuses and methods for cleaning. More specifically, the invention is an apparatus and method for cleaning that utilizes vacuum technology (collectively the "apparatus").

According to the October 2010 issue of *Medicine & Science in Sports & Exercise*, Americans take an average of 5,117 steps each day. Even though many Americans rely on motorized transport to take them to destinations for work, school, shopping, and recreation, the average American still walks more than 2 miles each day. The typical person takes approximately 2,000 steps per mile.

Any article of clothing gets dirty over time. However, footwear is particularly susceptible to becoming dirty because of the repeated contact to the ground and the outdoor environment. When walking outside, footwear is exposed to the elements such as snow, sand, water, dirt, mud, dust, slush, ice, and other substances (collectively "debris").

The accumulation of debris on footwear is not just a matter of aesthetics. Debris can make it easy for the wearer of the footwear to slip and fall. Nor is the accumulation of footwear debris only a problem for the wearer of the footwear. Offices, retail stores, auditoriums, sports arenas, schools, industrial sites, and other settings are impacted by the accumulated footwear debris of their visitors. For example, the accumulated footwear debris brought into a shopping mall during the winter Christmas holiday season can be a significant aesthetic and safety issue for the mall. Footwear debris can also create problems relating to health, hygiene, and sanitation in places such as restaurants and hospitals.

The accumulation of debris on the foot is not limited to interior environments. For example, beach goers at an ocean side resort may bring unwanted sand from the beach into an exterior pool area, hotel, boat, restaurant, or automobile.

It retrospect, it would be desirable to provide people with a convenient and cost efficient technology capable of cleaning feet, footwear, and even other items capable of being encumbered with debris. In hindsight, it would also be desirable for such technology to utilize vacuum suction so that the person using the technology does not need to exert physical effort in removing debris from their person or possessions.

Unfortunately, the prior art teaches away from such approaches for a variety of reasons. The potential for user error and resulting safety issues deter against vacuum approaches in automated technologies. Such considerations are further complicated by the significant variety of different footwear and foot characteristics to be processed by a one-size-fits-all approach.

A small child will weigh significantly less than a large-framed obese adult male. The universe of women's shoes includes some very narrow heels that could conceivably get stuck in a vacuum-based cleaning device. Insufficient suction (or insufficient vacuum conditions) precludes effective cleaning. Conversely, sufficient suction power can cause problems if the geometry of the device or the cleaned item permits the cleaned item to become stuck in the device.

SUMMARY OF THE INVENTION

The invention relates generally to apparatuses and methods for cleaning. More specifically, the invention is an apparatus and method for cleaning that utilizes vacuum technology (collectively the "apparatus").

The apparatus can be implemented using wet vacuum technology in conjunction with water as well as with dry vacuum technology.

The apparatus can be used to clean the shoes or even the bare feet of the person walking onto the apparatus. The apparatus can also potentially be used for items besides feet or footwear, including for example sports equipment, packages, and other items that can benefit from vacuum-based cleaning.

Vacuum conditions in the vacuum chamber of the apparatus can be maintained by a variety of tension-protrusion assemblies that include a tension component and a protrusion component. The tension component (which in many instances could also be called a compression component) partially counteracts the force of the mass placed on the apparatus, mass which can include that of a human being in many embodiments of the apparatus. The protrusion component in conjunction with a space in a top plate creates a gap that is small enough to sustain substantially vacuum conditions while large enough to permit the flow of air and in some embodiments, water.

The apparatus can be implemented as a stand-alone device or in a modular framework in which multiple units of the apparatus are connected in concert with each other. In some embodiments, the apparatus can be implemented in a highly embedded manner, such as being built into the floor in the entryway of a shopping mall or office building. The apparatus can also be implemented in highly mobile manner, allowing for consumers to store away the apparatus in a closet when the apparatus is not being used.

The apparatus can be more fully understood upon reading the accompanying drawings that are discussed briefly below.

BRIEF DESCRIPTION OF THE DRAWINGS

The following drawings illustrate different examples and embodiments of the apparatus:

FIG. 6*l* is a plan view diagram illustrating an example of a cross section side view of a tension-protrusion assembly.

The apparatus can be more fully understood upon reading the following detailed description.

DETAILED DESCRIPTION

The invention relates generally to apparatuses and methods for cleaning. More specifically, the invention is an apparatus and method for cleaning that utilizes vacuum technology (collectively the "apparatus").

The apparatus can be implemented in wide variety of different configurations. In accordance with the provisions of the patent statutes, the principles and modes of operation of this invention have been explained and illustrated in preferred embodiments. However, it must be understood that this invention may be practiced otherwise than is specifically explained and illustrated without departing from its spirit or scope. For example, the apparatus can be implemented in a wide range of difference shapes and sizes, utilizing a wide range of different components. In many embodiments, the apparatus will be in the shape of a cube or a rectangular block, but other shapes are possible. The apparatus is readily scalable, and can be implemented in a modular manner. The apparatus can also be implemented in a fully mobile and portable configuration, as well as permanently embedded into a particular location.

The apparatus can be adapted in a variety of alternative embodiments to better address specific operating requirements in specific operating contexts.

I. OVERVIEW

Figure 1A:
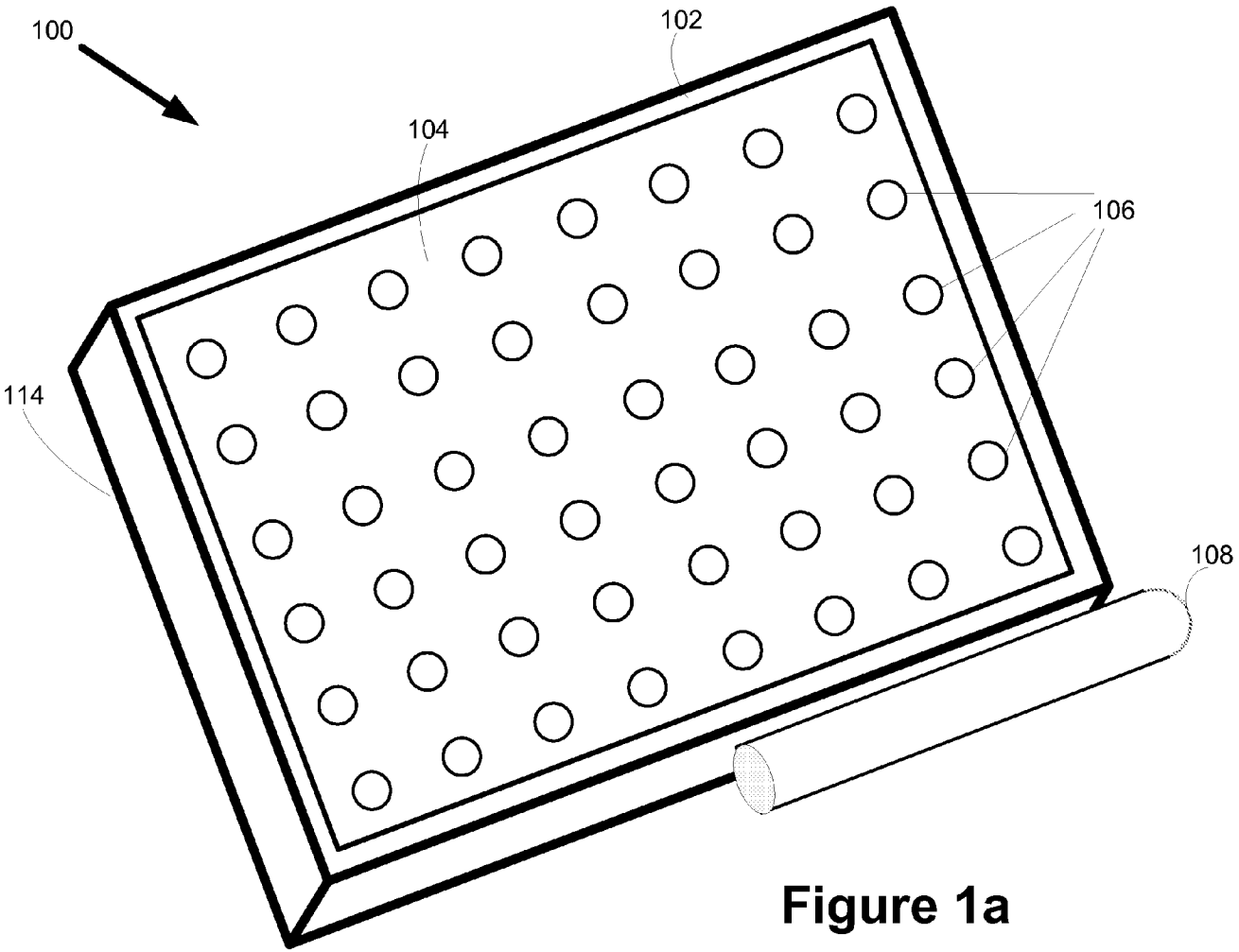
FIG. 1*a* is a perspective view diagram illustrating an example of a top view of an apparatus.

FIGS. 1*a*-6*r* collectively illustrate (1) different examples of a cleaning apparatuses 100 that utilizes vacuum technology and (2) different components and component configurations that can be utilized in such apparatuses 100. The apparatus can include a variety of different components and component configurations. FIG. 1*a* is a perspective diagram illustrating an example of an embodiment of the apparatus 100 that is fully assembled. FIG. 1*b* is top view illustration of the apparatus 100 illustrated in FIG. 1*a*. In FIG. 1*b*, the operating environment of the apparatus 100 is also displayed. The apparatus 100 is embedded within a floor 99 instead of being place on the floor 99.

A. Vacuum Cleaner

The apparatus 100 can be used in conjunction with a wide variety of different vacuum cleaners. The requirements for suction power will necessarily be impacted by the size and intended context of the apparatus 100.

Figure 1B:
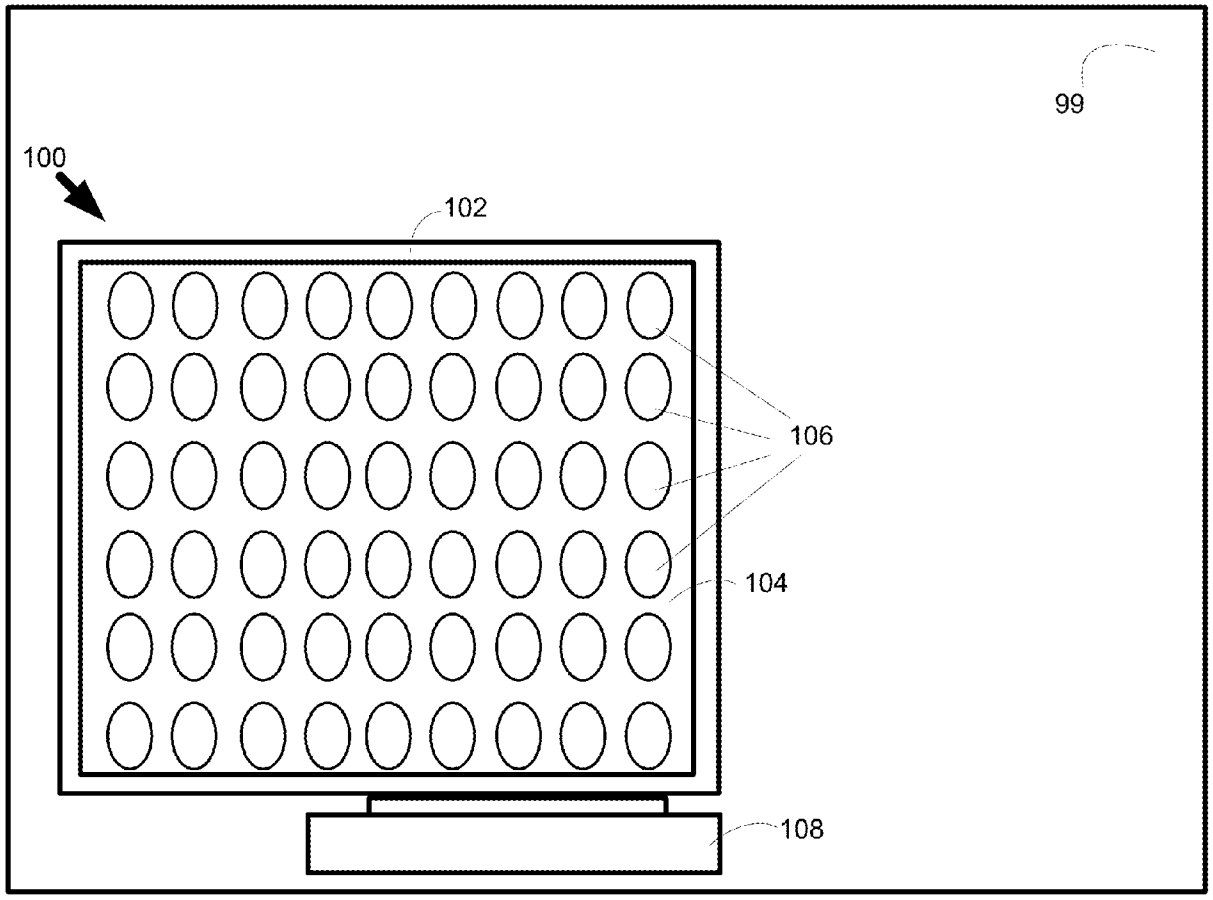
FIG. 1*b* is a plan view diagram illustrating a top view of an apparatus. In the example of the apparatus illustrated in FIG. 1*b*, the apparatus is embedded in a floor.

As illustrated in FIGS. 1*a* and 1*b*, the apparatus 100 can include a vacuum adapter 108 (or simply an adapter 108). The suction of the vacuum cleaner operates to the apparatus 100 through the adapter 108. The purpose of the adapter 108 to connect the apparatus 100 to a vacuum cleaner (or some similar device that provides for generating suction force) that is otherwise separate and distinct from the apparatus 100. Although the marketplace can provide a wide range of product options for vacuum cleaners, there are a relatively narrow range of connection geometries that are typically used in the vacuum cleaner industry. Moreover the adaptor 108 can utilize a variety of extensions or plugs to facilitate compatibility with a wide range of different vacuum cleaner configurations.

In most embodiments, it is advantageous to provide vacuum functionality to the apparatus 100 through the adapter 108 that is capable of being connected to various different vacuum devices rather than permanently building in the vacuum cleaner device into the apparatus 100 (or vice versa). A modular approach to the apparatus 100 that allows different components to be moved around can provide beneficial flexibility. An apparatus 100 permanently attached with an embedded vacuum cleaner is thus less desirable in most circumstances.

B. Core Functionality

The apparatus 100 uses vacuum technology, i.e. suction power, to facilitate the function of cleaning. The original inspiration behind the design of the apparatus 100 is the use of vacuum technology to clean shoes and feet, but at least some embodiments of the apparatus 100 can also be used outside of those contexts.

1. Loading the Apparatus

Figure 2A:
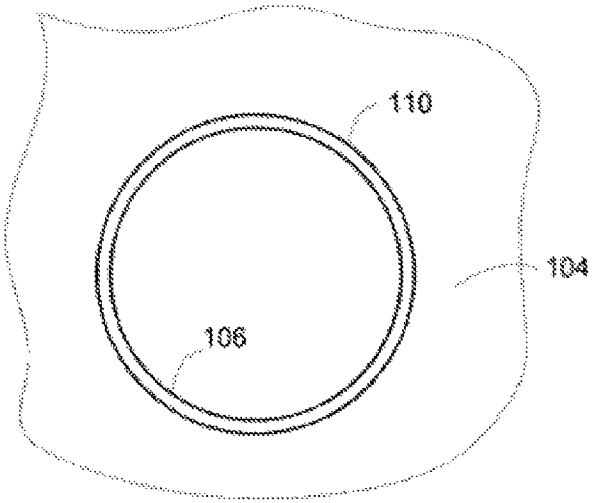
FIG. 2*a* is a plan view diagram illustrating an example of "close-up" top view of a portion of the illustration of FIG. 1*b* in which a protrusion component sticks out of an opening in a top plate.

Use of the apparatus 100 involves loading the apparatus 100, i.e. placing a mass on the top surface of the apparatus 100. As illustrated in FIG. 1*a*, the apparatus 100 has a top plate 104 with a variety of protrusions 106 sticking up through the top plate 104. FIG. 2*a* provides a close up top view of a protrusion component 106 in the shape of a hemisphere protruding upwards through a circular opening 110 in the top plate 104. Loading the apparatus 100 involves placing the load on one or more protrusions 106, placing downward force on one or more protrusions 106. For example, a human being wearing shoes steps onto the top plate 104 of the apparatus 100, stepping on some of the protrusions 106, resulting in the application of downward force on those protrusions 106.

2. Compression of the Tension Component

Figure 2B:
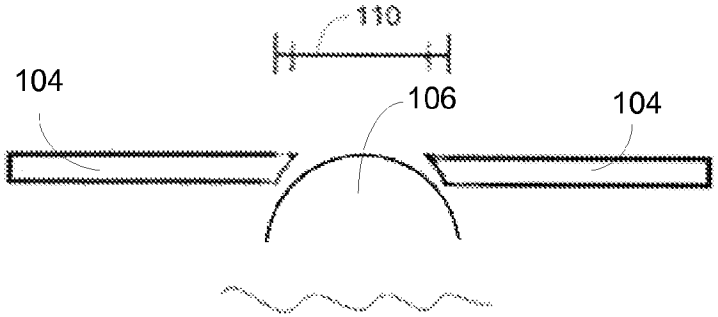
FIG. 2*b* is a plan view diagram illustrating an example of a cross-section side view of a protrusion component when a mass is loaded on the apparatus and the apparatus is in a state of maximum displacement.
Figure 2C:
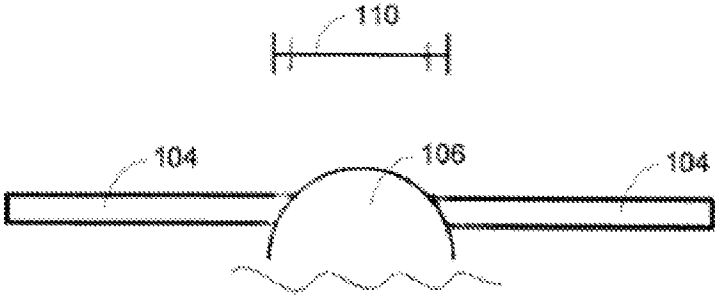
FIG. 2*c* is a plan view diagram similar to FIG. 2*b*, except that the illustrated example is that of an apparatus that is not loaded, with the protrusion component sticking up above the top plate, i.e. a state of minimum displacement.
Figure 2D:
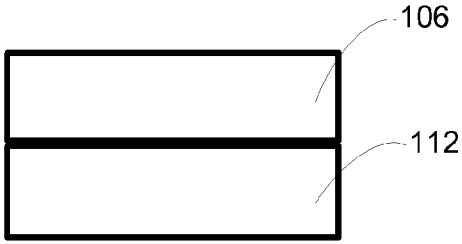
FIG. 2*d* is a block diagram illustrating an example of a cross section side view of a tension-protrusion assembly.

As illustrated in the block diagram of FIG. 2*d*, a protrusion component 106 is supported by a tension component 112, which can also be referred to as a compression component 112. The tension component 112 serves to allow the vertical motion of protrusion component 106 while at the same time acting to resist the magnitude of such motion. In many embodiments, the tension component 112 is some type of spring or an assembly that includes one or more springs.

The tension component 112 permits but also impedes the downward movement of the protrusion component 106. The result of that slight downward motion is to open a slight gap in the top surface of the apparatus 100.

3. Gap to Facilitate Cleaning

In stepping on the apparatus 100, a slight gap is opened on the top surface of the apparatus 100 to permit sufficient air flow to facilitate cleaning. If the gap is too small, there is insufficient throughput for the debris being cleaned. If the gap is too large, then the suction power of the vacuum is negated, negatively impacting the ability of the apparatus 100 to perform the cleaning function of the apparatus 100.

FIG. 2*c* illustrates an example of a protrusion component 106 in a fully unloaded state. The protrusion component 106 fits snuggly in the opening 110 in the top plate 104. In contrast, FIG. 2*b* illustrates the same components when the protrusion component 106 is loaded. As is illustrated in FIG. 2*b*, there is a small gap between the protrusion component 106 and the top plate 104 that does not exist in FIG. 2*c*. That gap must be the appropriate size to facilitate the throughput of debris while still maintaining near-vacuum conditions within the apparatus 100 itself.

Both FIGS. 2*b* and 2*c* reveal that it can be desirable to have a tapered opening 110 in the top plate 104. The opening 110 is wider at the bottom of the top plate 104 than it is in the top of the top plate 104.

C. Wet Vacuum and Dry Vacuum Embodiments

The apparatus 100 can be implemented to utilize wet vacuum technology in conjunction with the application of water to perform the cleaning function of the apparatus 100. The apparatus 100 can also be implemented to utilize dry vacuum technology without the use of water to perform the cleaning function of the apparatus 100.

D. Modular and Non-Modular Embodiments

The apparatus 100 can be implemented in a modular manner that allows the apparatus 100 to connect with other apparatuses 100 to provide a wider area of functionality. FIGS. 6*b* and 6*m* illustrate how multiple apparatuses 100 can function as a single unit in a highly modular approach.

As illustrated in FIGS. 1*a* and 1*b*, the apparatus 100 can also be implemented as a single stand-alone embodiment.

E. Portable and Embedded Embodiments

The apparatus 100 can be embodied in a highly portable device that consumers can take with them when they travel. The apparatus 100 can also be embodied in less mobile embodiments that can even involve embedding the apparatus 100 into specific locations as other types of fixtures are incorporated into living and office space.

F. Materials

The various components of the apparatus 100 can be comprised of a wide variety of different materials. In order to support the weight of human beings, many components such as the frame 102, top plate 104, and bottom plate 114 will often be comprised of a metal, such as aluminum. Other items such as the adapter 108 or protrusion components 106 can be comprised of plastic.

II. INTRODUCTION OF ELEMENTS AND DEFINITIONS

FIG. 1*a* is a perspective diagram illustrating an example of an apparatus 100. FIG. 1*b* is a plan view diagram illustrating a top view of an apparatus 100 illustrated in FIG. 1*a*. In the example of the apparatus 100 illustrated in FIG. 1*b*, the apparatus 100 is embedded in a floor 99.

A. Frame

A frame 102 of the apparatus 100 can serve a variety of purposes for the proper functioning of the apparatus 100. The frame 102 can help implement the applicable vacuum-like conditions between a bottom plate 114 and a top plate 104 to support the functioning of the apparatus 100. The frame 102 can also serve to keep various components of the apparatus 100 in the appropriate and desired positions.

Figure 3A:
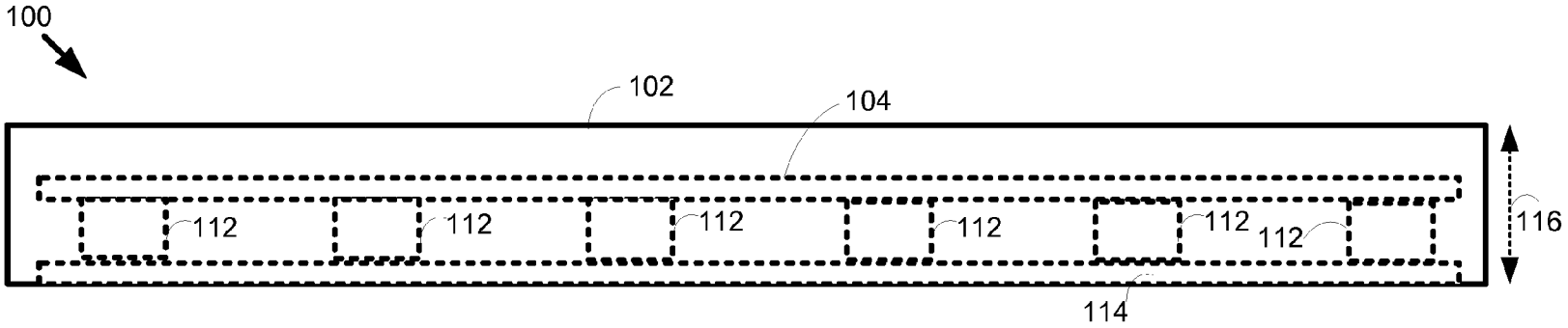
FIG. 3*a* is a plan view diagram illustrating an example of a cross section side view of the apparatus and the positioning of different components hidden from view by the frame.

Examples of frames 102 are illustrated in FIGS. 1*a*, 1*b*, and 3*a*. A frame 102 can be comprised of various L-brackets 127 (see FIGS. 6*d* and 6*j*) and/or U-brackets 126 (see FIG. 6*a*)

The frame 102 is typically rectangular in shape, although it can be implemented in different shapes. The frame 102 also assists in sustaining near vacuum conditions between the top plate 104 and the bottom plate 114. The frame 102 can be made of a wide variety of different materials. In most embodiments of the apparatus 100, the frame 102 is stationary throughout the use of the apparatus 100. A frame height 116 (see FIG. 3*a*) exceeds a maximum top plate vertical position 120 (see FIG. 3*c*) as well as the minimum top plate vertical position 118 (see FIG. 3*b*).

B. Bottom Plate

FIG. 1*a* illustrates an example of a bottom plate 114. The bottom plate 114 is not visible in FIG. 1*b* because FIG. 1*b* is a top view of the apparatus 100.

Examples of a bottom plate 114 are also illustrated in FIGS. 3*a*, 3*b*, 3*c*, 3*d*, 4*a*, 4*b*, 4*c*, 6*a*, 6*b*, 6*n*, and 6*o*. The bottom plate 114 forms the base of the apparatus 100. In conjunction with the top plate 104 and the frame 102, the bottom plate 114 helps sustain near vacuum conditions within the apparatus 100. In most embodiments of the apparatus 100, the bottom plate 114 is stationary through the use of the apparatus 100. In many embodiments of the apparatus 100, the bottom plate 114 is comprised of aluminum, although a wide variety of different materials and component configurations can be used.

C. Top Plate

Both FIGS. 1*a* and 1*b* illustrate examples of a top plate 104. Top plates 104 are also at least partially illustrated in FIGS. 2*a*, 2*b*, 2*c*, 3*a*, 3*b*, 3*c*, 3*d*, 4*a*, 4*b*, 4*c*, 6*c*, 6*j*, 6*k*, 6*m*, 6*n*, and 6*o*.

In conjunction with the bottom plate 114 and the frame 102, the top plate 104 helps sustain near vacuum conditions within the apparatus 100. In many embodiments, the position of the top plate 104 is fixed, with one or more aspects of the tension-protrusion assembly moving in response to the load of the apparatus 100. In a preferred embodiment, the position of the top plate 104 is fixed regardless of whether the apparatus 100 is loaded.

In other embodiments, the top plate 104 may be supported by a tension-protrusion assembly and move when the load on the apparatus 100 is changed. In such embodiments, the position of the top plate 104 will vary from a maximum vertical position 120 with respect to the bottom plate 114, and a minimum vertical position 118.

Something in the apparatus 100 will move when the apparatus 100 is loaded, so there will relative positions in the apparatus 100 that will be different when the apparatus 100 is loaded from when the apparatus 100 is not loaded.

In embodiments where the top plate 104 does not move, the distance between the top surface of the top plate 104 and the top of the protrusion component 106 changes when the magnitude of the load on the apparatus 100 changes.

In embodiments where the top plate 104 does move, the distance between the top surface of the top plate 104 and the bottom surface of the bottom plate 114 changes when the magnitude of the load on the apparatus 100 changes.

D. Openings/Holes in the Top Plate

One important attribute of the top plate 104 are the openings 110 in the top plate 104 that provide for the positioning of a protrusion component 106 upward through the top plate 104.

Examples of openings 110 are disclosed in FIGS. 1*c*-1*e* and 1 *g*-1*i*. A number of openings 110 in the top plate 104 provide for maintaining a balance between (a) the absence of air and water flow between the area above the top plate 104 and the area below the top plate 104; and (b) inadequate vacuum conditions for the effective cleaning of a connected vacuum cleaner. In a preferred embodiment, the openings 110 will be circular or some other type of elliptical shape, although alternative shapes are possible. The geometry of the openings 110 should be designed with the geometry of an applicable protrusion component 106.

E. Tension-Protrusion Assembly

As discussed above, the core functionality of the apparatus 100 involves the loading of a tension-protrusion assembly 133 as illustrated by the block diagram in FIG. 2*d*, as well as in less abstract figures such as FIGS. 4*a*, 4*b*, 4*c*, 6*f*, 6*i*, 6*l*, 6*n*, and 6*o*.

The apparatus 100 can utilize a wide variety of different tension-protrusion assemblies 13 to facilitate the proper vertical motion of the top plate 104 in response to the loading of the apparatus 100 (putting mass on the apparatus 100) and the unloading of the apparatus 100 (removing mass from the apparatus 100).

The tension-protrusion assembly can utilize a wide variety of different component parts, subassemblies, and configurations. Each tension-protrusion assembly will typically include a tension component 112 and a protrusion component 106.

1. Protrusion Component

Examples of protrusion components 106 are illustrated in FIGS. 1*a*, 1*b*, 1*c*, 1*d*, and 1*e*. In many embodiments of the apparatus 100, the protrusion component 106 will be positioned on top of the tension component 112. A protrusion component 106 is the component in conjunction with the openings 110 that creates the geometry for enabling the proper air and water flow in the apparatus 100. In many embodiments, the protrusion component is a half-sphere. Other geometric shapes can also be used.

Many embodiments of the protrusion components 106 will be hollow hemispheres 132 comprised of polyethylene and filled with silicon.

2. Tension Component

Examples of tension components 112 are illustrated in FIGS. 1*f*-1*i*. A wide variety of components are capable of serving as a tension component 112, and thus a tension component 112 is illustrated by the "black box" in FIGS. 1*f*-1*i*. Common examples of tension components 112 are springs, but any device capable of contracting upon the loading of the apparatus 100, and then expanding back upon the unloading of the apparatus 100 can potentially serve as a tension component 112 for the apparatus 100.

In many embodiments, flat springs 134 coupled into pairs will be used to collectedly support four hemispheres 132 comprised of polyethylene and at least partially filled with silicon.

F. Mat

Figure 3B:
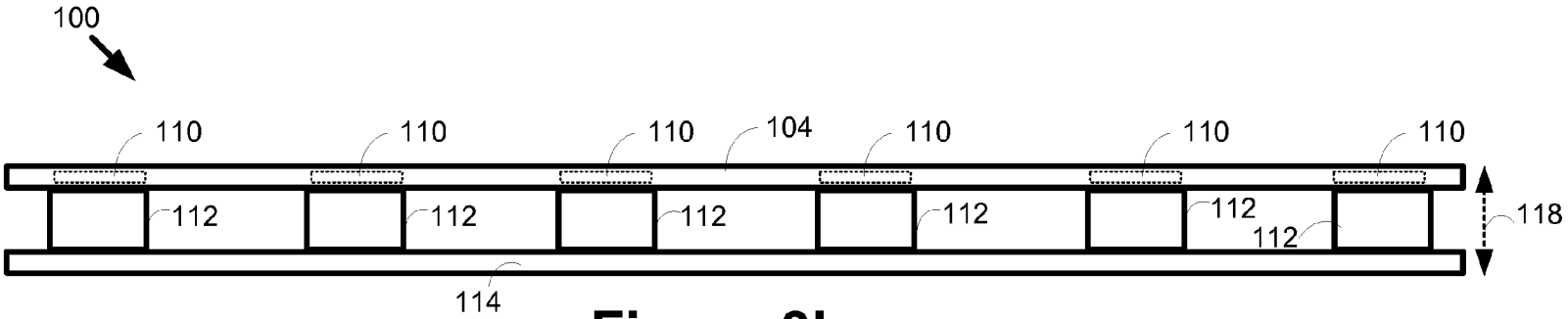
FIG. 3*b* is a plan view diagram illustrating an example of a cross section side view of the apparatus in an unloaded state without any displacement, unblocked by the frame of the apparatus.
Figure 3C:
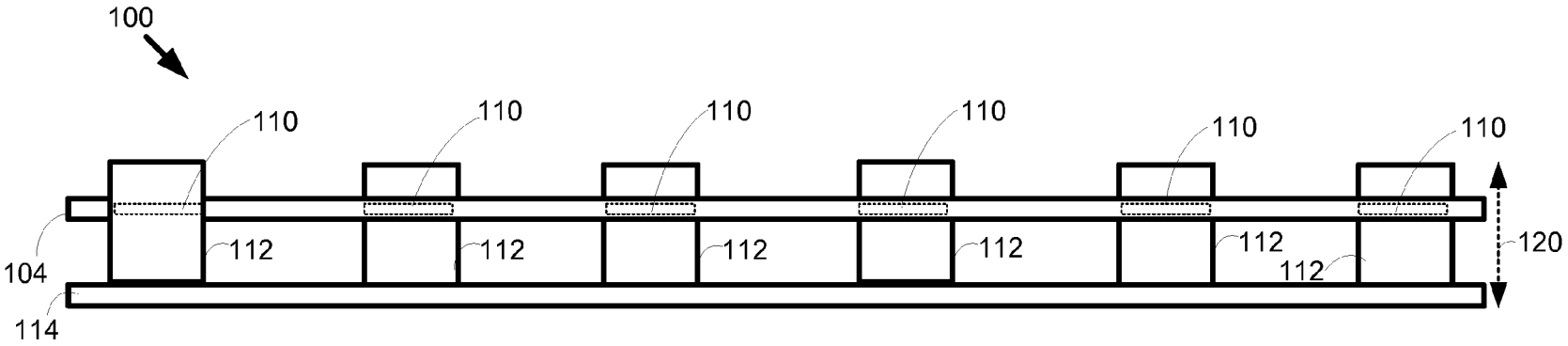
FIG. 3*c* is a plan view diagram illustrating an example of a cross section side view of the apparatus similar to FIG. 3*b*, except that the apparatus is in a loaded state with maximum displacement.
Figure 3D:
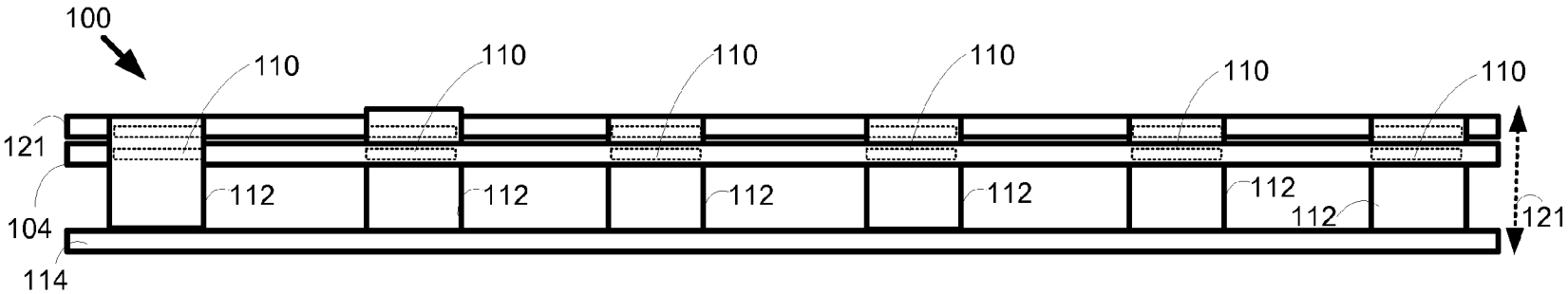
FIG. 3*d* is a plan view diagram illustrating an example of a cross section side view of the apparatus that includes a mat on top of a top plate, impacting the magnitude of displacement of the protrusion component.

FIG. 3*d* illustrates an example of a mat 121 sitting on top of the top plate 104. A mat 121 is an optional component of the apparatus 100. In many embodiments, the mat 121 can be removed from the apparatus 100 by the user/owner of the apparatus 100. The mat 121 serves the function of allowing the user to more easily remove excess debris from their feet, shoes, or other surface.

III. LOADING/UNLOADING OF THE TENSION-PROTRUSION ASSEMBLY

As discussed above, the tension-protrusion assembly 133 of the apparatus 100 is the part of the apparatus 100 that moves with the loading/unloading of the apparatus 100. In most embodiments, the loading and loading of the apparatus 100 only involves the movement of components that comprise the tension-protrusion assembly 133.

As illustrated by the block diagrams of FIGS. 2*d*, 3*a*, 3*b*, 3*c*, and 3*d*, the tension-protrusion assembly 133 of the apparatus 100 can include a wide variety of different shapes and sizes of protrusion components 106, tension components 112, and component configurations.

Figure 4A:
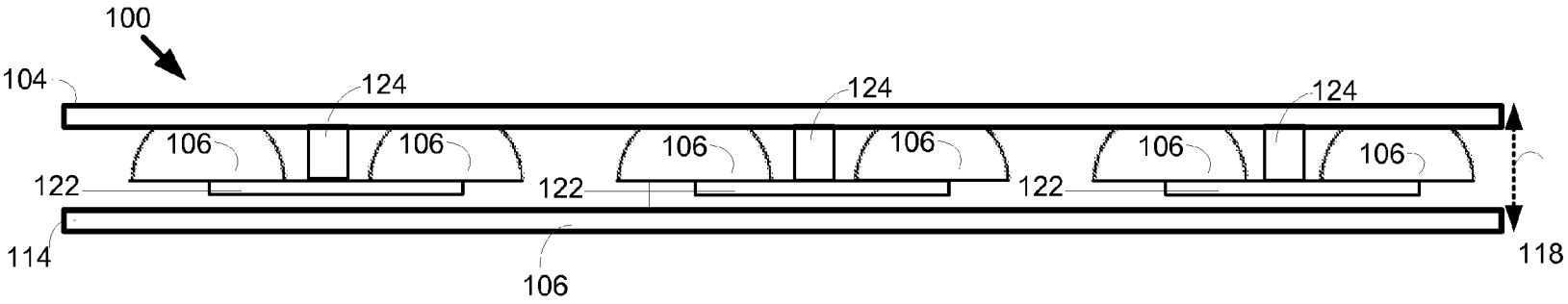
FIG. 4*a* is a plan view diagram illustrating an example of a cross section side view of a tension-protrusion assembly in a state of maximum compression.
Figure 4B:
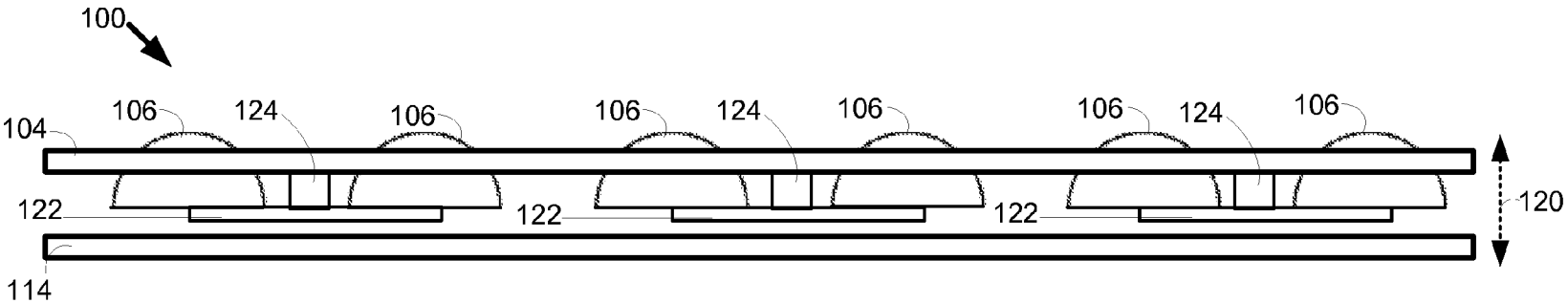
FIG. 4*b* is a plan view diagram illustrating an example of a cross section side view of a tension-protrusion assembly in a state of minimum compression.
Figure 4C:
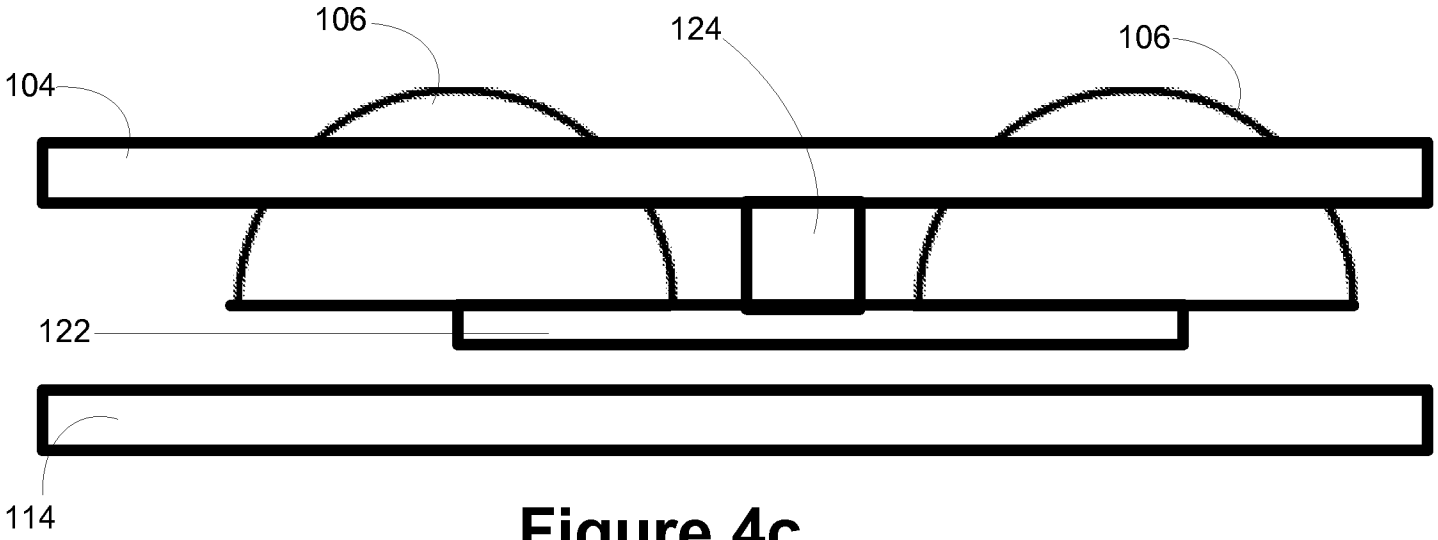
FIG. 4*c* is a close up view of a single tension-protrusion assembly from FIG. 4*b*.

As illustrated by the less abstract diagrams of FIGS. 2*a*, 2*b*, 2*c*, 4*a*, 4*b*, and 4*c*, the tension-protrusion assembly 133 will often include a protrusion component 106 in the shape of a hemisphere and a spring 122 as the tension component 112. FIG. 4*c* in particular displays a tension-protrusion assembly 133 that is attached to the bottom surface of the top plate 104 by a connector 24 that connects the top plate 104 to the spring 122 and with the protrusion component 106 being attached to the spring 122.

Other examples of tension-protrusion assemblies 133 include FIGS. 6*f*, 6*i*, 6*k*, 6*l*, 6*n*, and 6*o*.

IV. RELATIVE MOTION/DISTANCES WITHIN THE APPARATUS

As noted above, in many embodiments of the apparatus 100, only the tension-protrusion assembly moves when the apparatus 100 is loaded/unloaded. It can be useful to identify certain distances and how such distances vary between a loaded and unloaded state.

A. Distance Across the Opening

As illustrated in FIGS. 2*b* and 2*c*, the distance across the openings 110 in the top plate don't change with the loading/unloading of the apparatus 100, but the opening can become progressively larger as the opening 110 progresses downwards from the top surface of the top plate 104.

B. Height of the Frame

As illustrated in FIG. 3*a*, the frame 102 is typically the highest point of the apparatus 100. At a minimum, the frame height 116 must be at least as tall as the top surface of the top plate 104.

C. Distance Between the Top and Bottom Plates

The vertical area between the top plate 104 and bottom plate 114 as surrounded by the frame 102 makes up what is an air tight chamber to facilitate the suction of debris through the apparatus 100 to the vacuum cleaner. In most embodiments the top plate 104 does not move with the loading/unloading of the apparatus 100, and as such a top plate/bottom plate distance 118 (as illustrated in FIG. 3*b*) is constant regardless of the operating state of the apparatus 100.

D. Distance Between Protrusion and Bottom Plate

In FIGS. 3*c* and 4*b*, element 120 is the distance between the uppermost portion of the protrusion component 108 and the plane of the bottom surface of the bottom plate 114 when the apparatus 100 is not loaded.

In FIGS. 3*d* and 4*a*, element 121 is the distance between the uppermost portion of the protrusion component 108 and the plane of the bottom surface of the bottom plate 114 when the apparatus 100 is loaded.

The different between distance 120 and distance 121 will vary in different embodiments of the apparatus 100. In many embodiments, that differential will be approximately 0.5 inches.

V. PROCESS FLOW VIEWS

As discussed above, the apparatus 100 can be implemented in both wet and dry embodiments.

A. Wet Embodiments

Figure 5A:
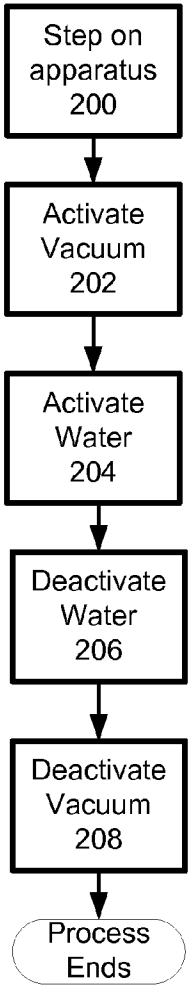
FIG. 5*a* is flow chart diagram illustrating an example of a process for using that apparatus that includes both vacuum and water.

FIG. 5*a* illustrates an example of a process for using the apparatus 100 that utilizes water in conjunction with vacuum suction to clean the load places in the apparatus 100.

At 200, the user steps onto the top plate 104 of the apparatus 100.

At 202, the vacuum is activated.

At 204, water is supplied to the area being cleaned.

At 206, the water is deactivated.

At 208, the vacuum suction is deactivated.

Then the process ends.

B. Dry Embodiments

Figure 5B:
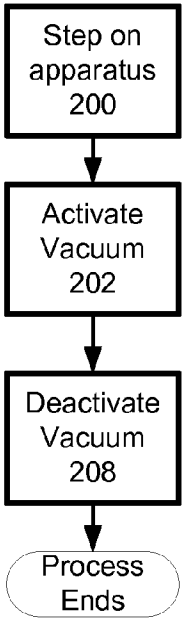
FIG. 5*b* is a flow chart diagram illustrating an example of a process for using the apparatus that includes vacuum but not the use of water.

FIG. 5*b* illustrates an example of a process for using the apparatus 100 that does not utilize water in conjunction with vacuum suction to clean the load places in the apparatus 100.

At 200, the user steps onto the top plate 104 of the apparatus 100.

At 202, the vacuum is activated.

At 208, the vacuum suction is deactivated.

Then the process ends.

VI. DETAILED DESCRIPTION OF VARIOUS COMPONENTS AND CONFIGURATIONS

FIG. 1*a* is a perspective view diagram illustrating an example of a top view of an apparatus 100. The apparatus 100 includes a frame 102, a top plate 104, a variety of protrusion components 106 shaped as hemispheres 132, a vacuum adapter 108, and a bottom plate 114. FIG. 1*b* is a plan view diagram illustrating an example of a top view of the apparatus 100 displayed in FIG. 1*a*.

FIG. 2*a* is a plan view diagram illustrating an example of "close-up" top view of a portion of the illustration of FIG. 1*b* in which a protrusion component 106 in the shape of a hemisphere sticks out of an opening 100 in a top plate 104.

FIG. 2*b* is a plan view diagram illustrating an example of a cross-section side view that corresponds to FIG. 2*a* when the apparatus is in a loaded operating state. FIG. 2*c* is a similar diagram, except that it relates to the apparatus 100 in an unloaded operating state.

FIG. 3*a* is a plan view diagram illustrating an example of a cross section side view of the apparatus 100 and the positioning of different components hidden from view by the frame 102. FIG. 3*b* illustrates the same configuration as FIG. 3*a*, except that the frame 102 is removed from view. FIGS. 3*a* and 3*b* pertain to a loaded state while FIGS. 3*c* and 3*d* pertain to an apparatus 100 in an unloaded state.

FIG. 4*a* is a plan view diagram illustrating an example of a cross section side view of three tension-protrusion assemblies 133 in a state of maximum compression within the apparatus 100. FIG. 4*b* relates to the same components as FIG. 4*a*, except that the apparatus 100 is an unloaded state. FIG. 4*c* is a close up view of a single tension-protrusion assembly from FIG. 4*b*.

Figure 6A:
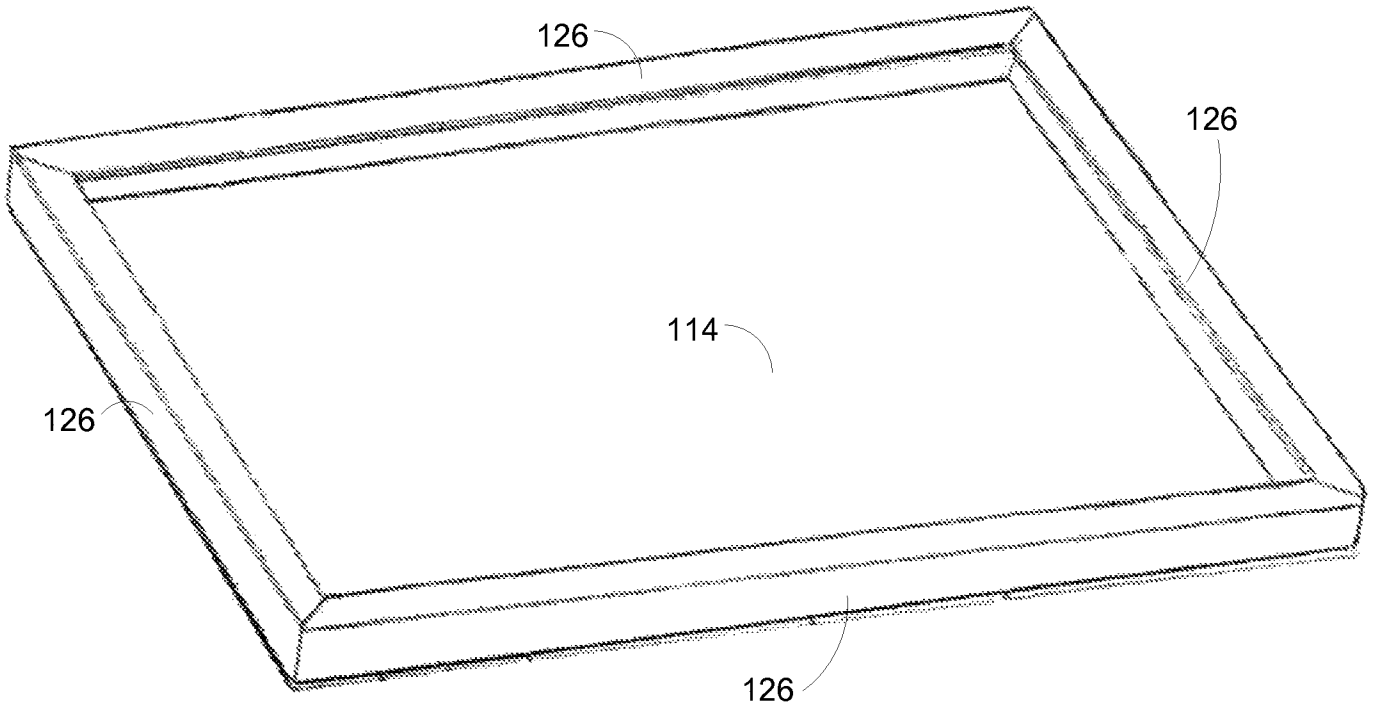
FIG. 6*a* is a perspective diagram illustrating an example of a bottom plate and frame.
Figure 6B:
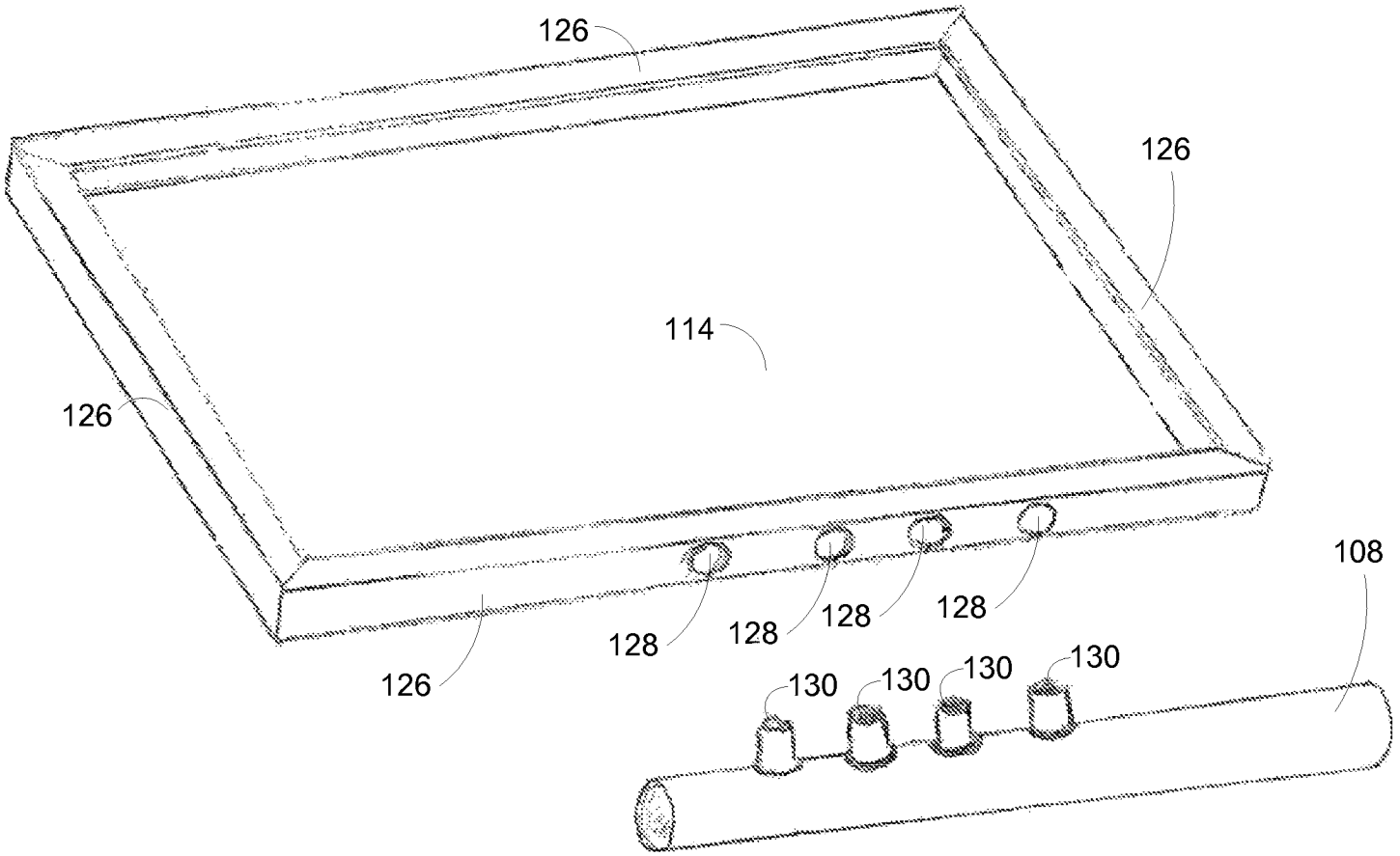
FIG. 6*b* is a perspective diagram illustrating an example of a bottom plate, frame, and an adaptor.

FIG. 6*a* is a perspective diagram illustrating an example of a bottom plate 114 and frame 102 comprised of U-brackets 126. The U-brackets 126 are comprised of aluminum, and are 14⅝" long, ⅛" thick, and ¾" wide with 45 degree cuts at the ends. The bottom plate 114 is also comprised of aluminum, that is 14⅝" wide, 20⅝" long, and 1/16" thick. The height of the partial frame 102 illustrated in FIG. 1*a* is approximately ¾" high.

FIG. 6*b* is a perspective diagram illustrating an example of a bottom plate 114, frame 102, and an adaptor 108. In addition to the components illustrated in FIG. 6*a*, a vacuum hose adapter 108 approximately 1¼" in diameter is also disclosed. The adaptor 108 includes male mating component 130 to connect with female mating components 129 in the U-brackets 126 of the frame 102.

Figure 6C:
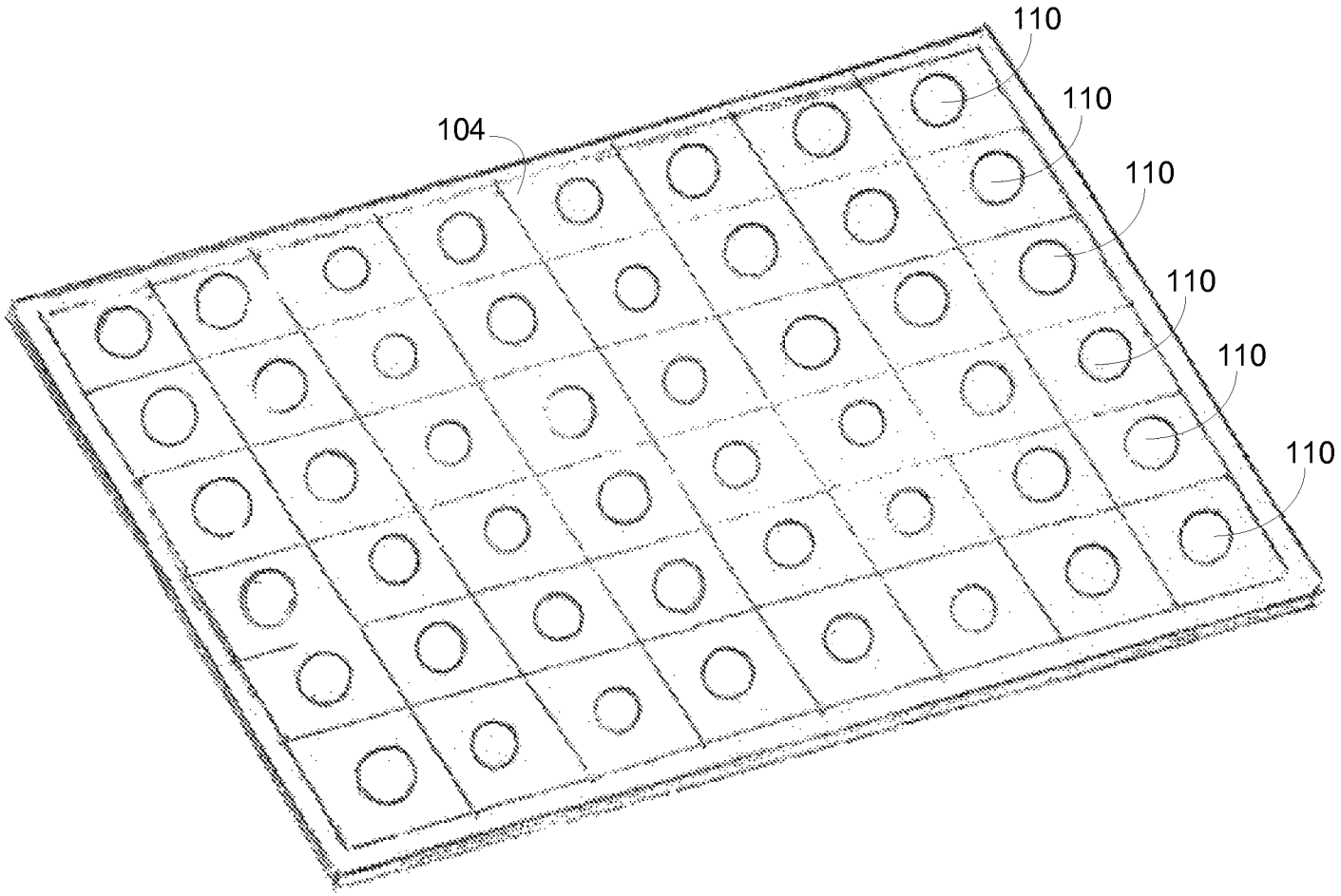
FIG. 6*c* is a perspective diagram illustrating an example of a top plate with circular openings.

FIG. 6*c* is a perspective diagram illustrating an example of a top surface of a top plate 104 with circular openings 110. The top plate 102 is comprised of aluminum; with dimensions correspond to those of the bottom plate 114. There are 48 tapered openings 110 measuring 1⅜" on the top side and 1½" on the bottom side. The top plate 104 includes a border that is wider than the rest of the top plate 104.

Figure 6D:
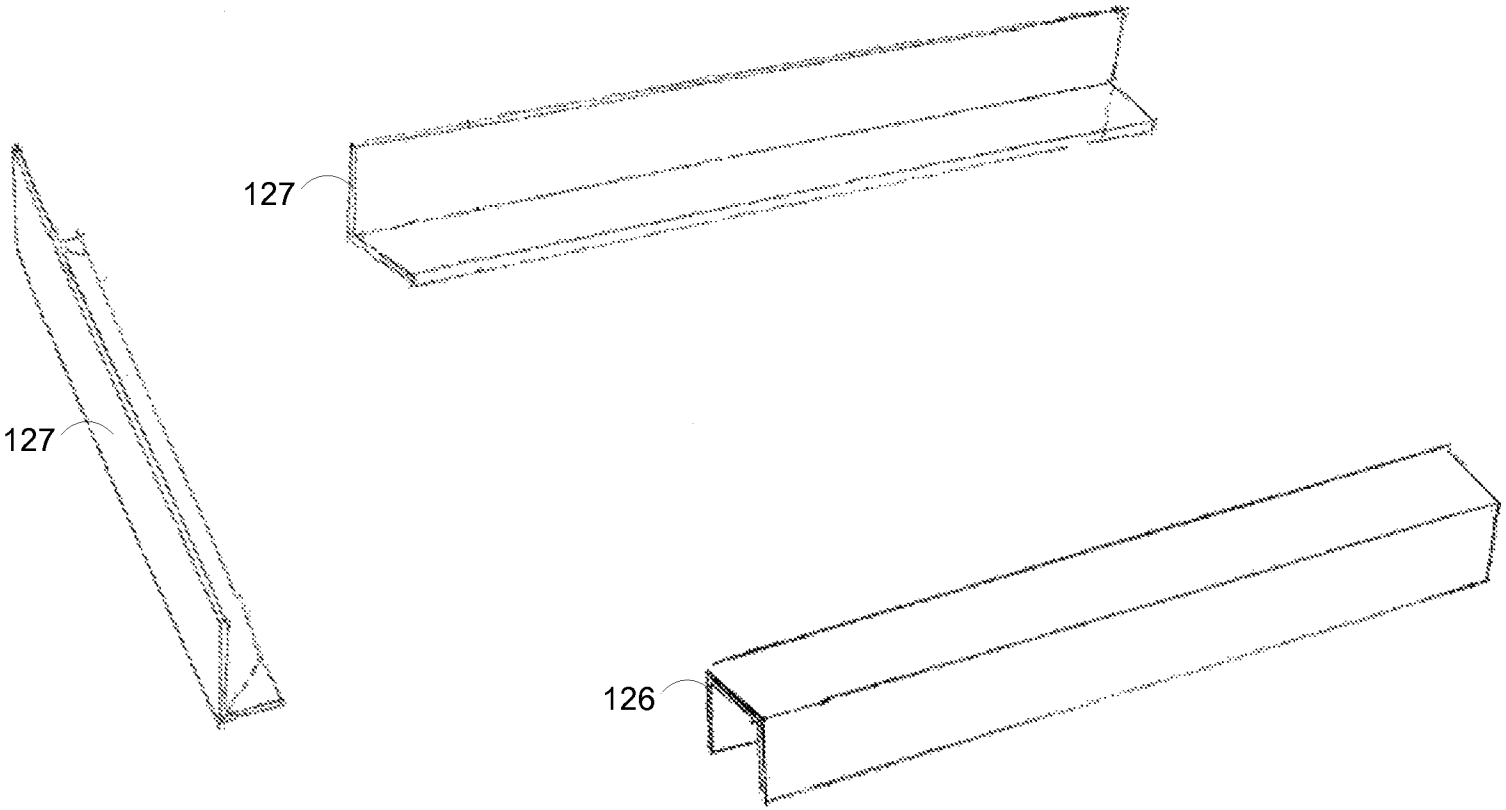
FIG. 6*d* is a perspective diagram illustrating examples of L and U brackets that can used to comprise the frame.

FIG. 6*d* is a perspective diagram illustrating examples of L brackets 127 and U brackets 128 that can used to comprise the frame 102. The U brackets 128 are used in modular embodiments of the apparatus 100 to cover the space between the various modules when connected together. The L brackets 127 are 12⅝" long, ½" wide, and 1/16" thick. They have 45 degree angle cuts added to the ends.

Figure 6G:
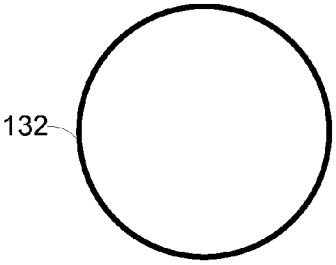
FIG. 6*g* is a plan view diagram illustrating an example of a top view of hemisphere.
Figure 6H:
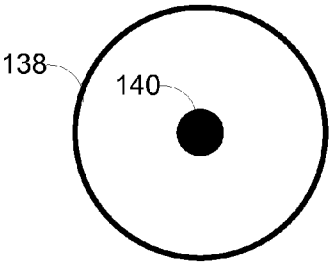
FIG. 6*h* is a plan view diagram illustrating an example of a top view of a donut used within the tension-protrusion assembly.
Figure 6F:
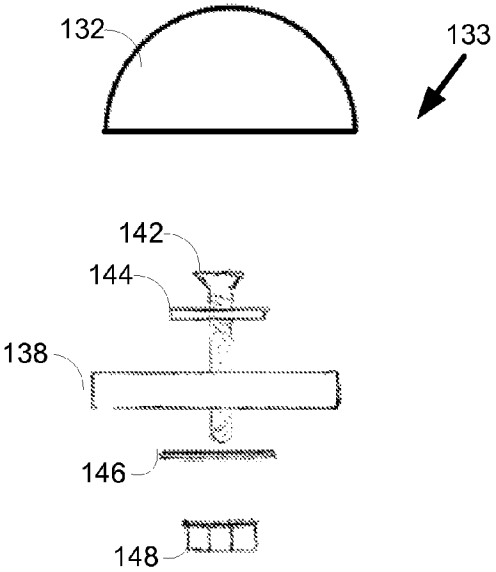
FIG. 6*f* is a plan view diagram illustrating an example of a cross section side view of a tension-protrusion assembly.
Figure 6E:
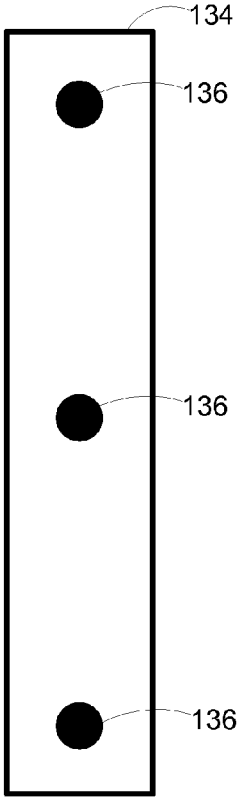
FIG. 6*e* is a plan view diagram illustrating an example of a top view of a flat spring.

FIG. 6*e* is a plan view diagram illustrating an example of a top view of a flat spring 134. The flat spring 134 illustrated in FIG. 6*e* is ¾" wide and 5" long. The flat spring 134 includes 3 holes 136, with a 3/16" center hole for mounting the spring 134 to the top plate 104 and the two other ⅛" holes for mounting the hemispheres 132 (i.e. protrusion components 106) to the spring 134. FIG. 6*f* is a plan view diagram illustrating an example of a cross section side view of a tension-protrusion assembly 133 that includes a hemisphere 132 with the dimensions of 1.5"×7.5", that is hollow with a wall thickness of ⅛". The assembly 133 also includes a screw 142, a small washer 144, a wooden donut 138, a large washer 146 and a hex nut 148. The spring 134 has thickness of 0.025" and is comprised of blue tempered shim stock. The wooden donut 138 has a 1¼" diameter, is ¼" thick, and has a center hole that is ¼" in diameter. FIG. 6*g* is a plan view diagram illustrating an example of a top view of hemisphere 132. FIG. 6*h* is a plan view diagram illustrating an example of a top view of a donut 138 used within the tension-protrusion assembly 133

Figure 6I:
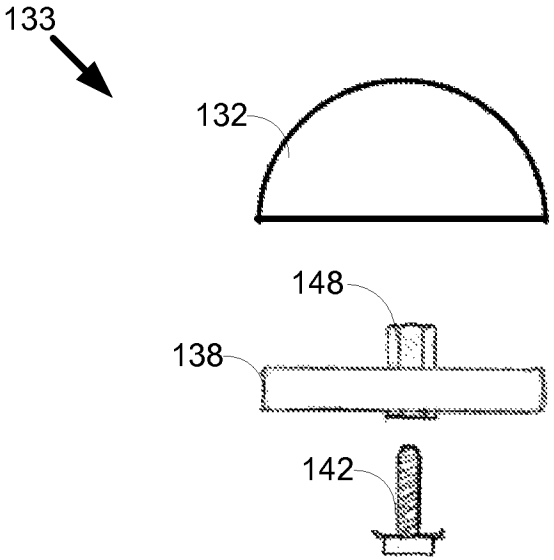
FIG. 6*i* is a plan view diagram illustrating an example of a cross section side view of a tension-protrusion assembly that does not include a connector on the top surface of the hemisphere.

FIG. 6*i* is a plan view diagram illustrating an example of a cross section side view of a tension-protrusion assembly 134 that does not include a connector on the top surface of the hemisphere 132. In FIG. 6*i*, the bolt 142 goes upward through the bottom of the hemisphere 132 rather than downwards from the top surface of the hemisphere 132.

Figure 6J:
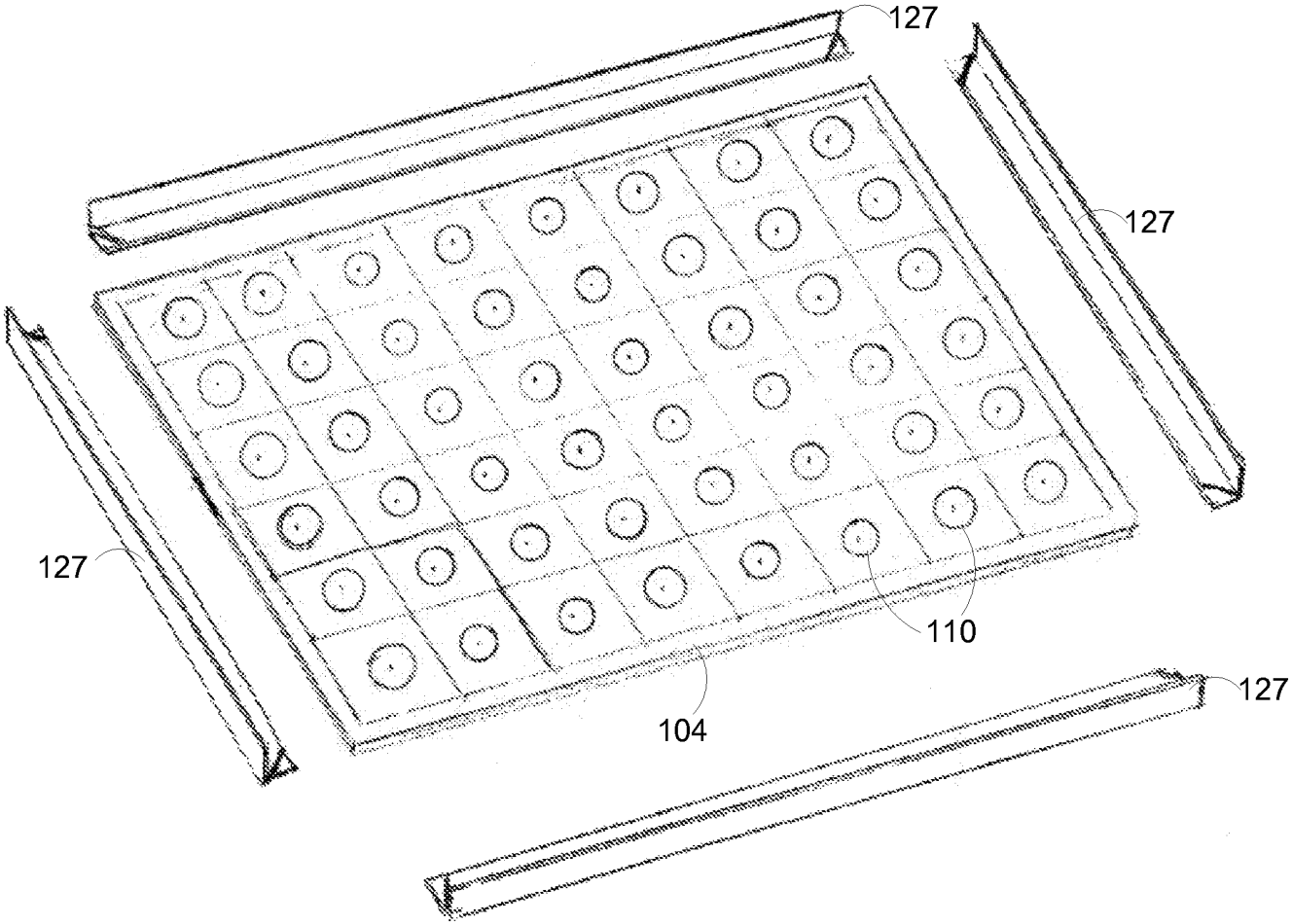
FIG. 6*j* is a perspective view diagram illustrating an example of a top view of top plate and various L joints comprising a frame.

FIG. 6*j* is a perspective view diagram illustrating an example of a top view of top plate 104 (as illustrated in FIG. 6*c*) and various L joints comprising the upper portion of the frame 102 that corresponds to the top plate 104 (in contrast to the bottom portion which corresponds to the bottom plate 114).

Figure 6K:
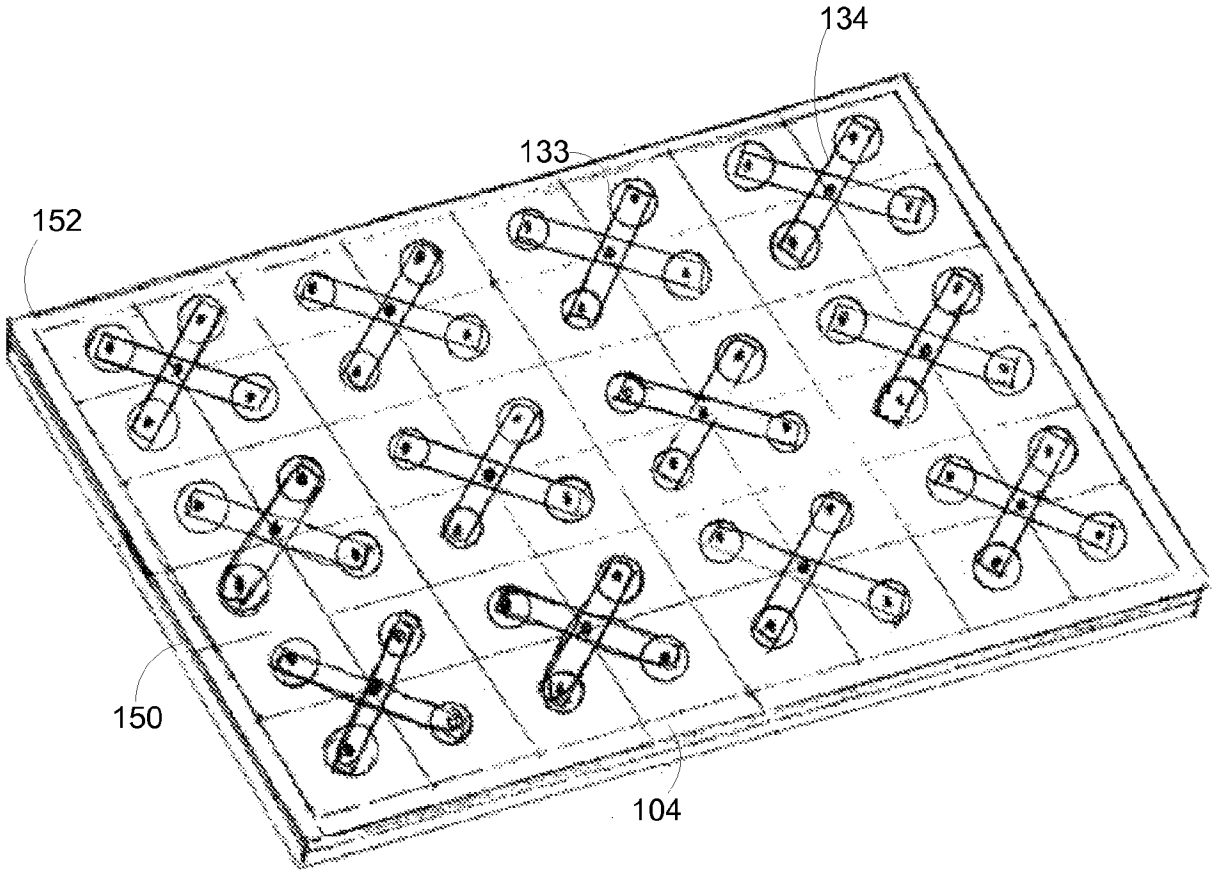
FIG. 6*k* is a perspective view diagram illustrating an example of a bottom view of a top plate and a configuration of tension-protrusion assemblies attached to the bottom surface of the top plate.
Figure 6I:
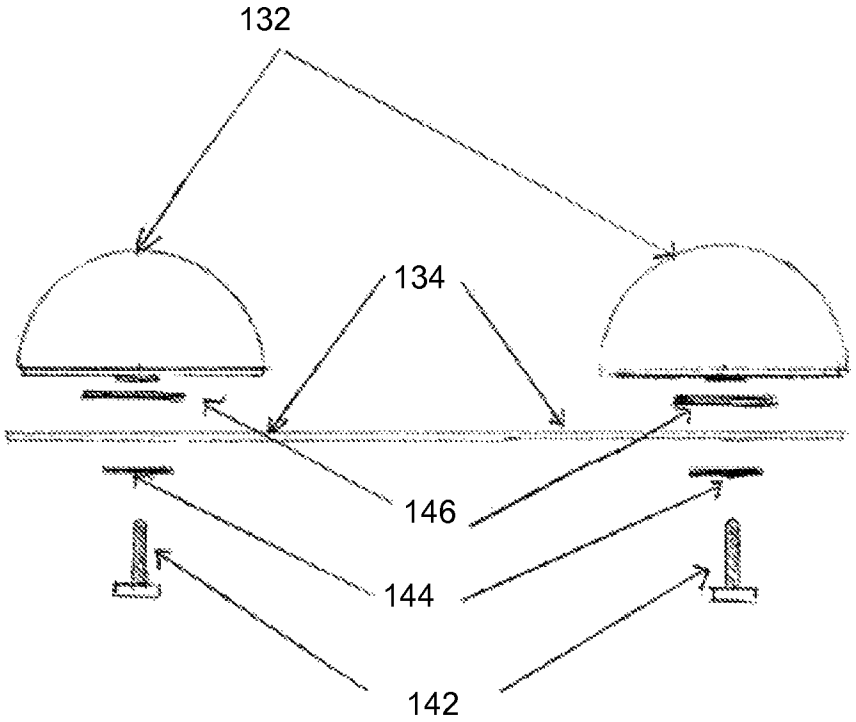
Figure 6M:
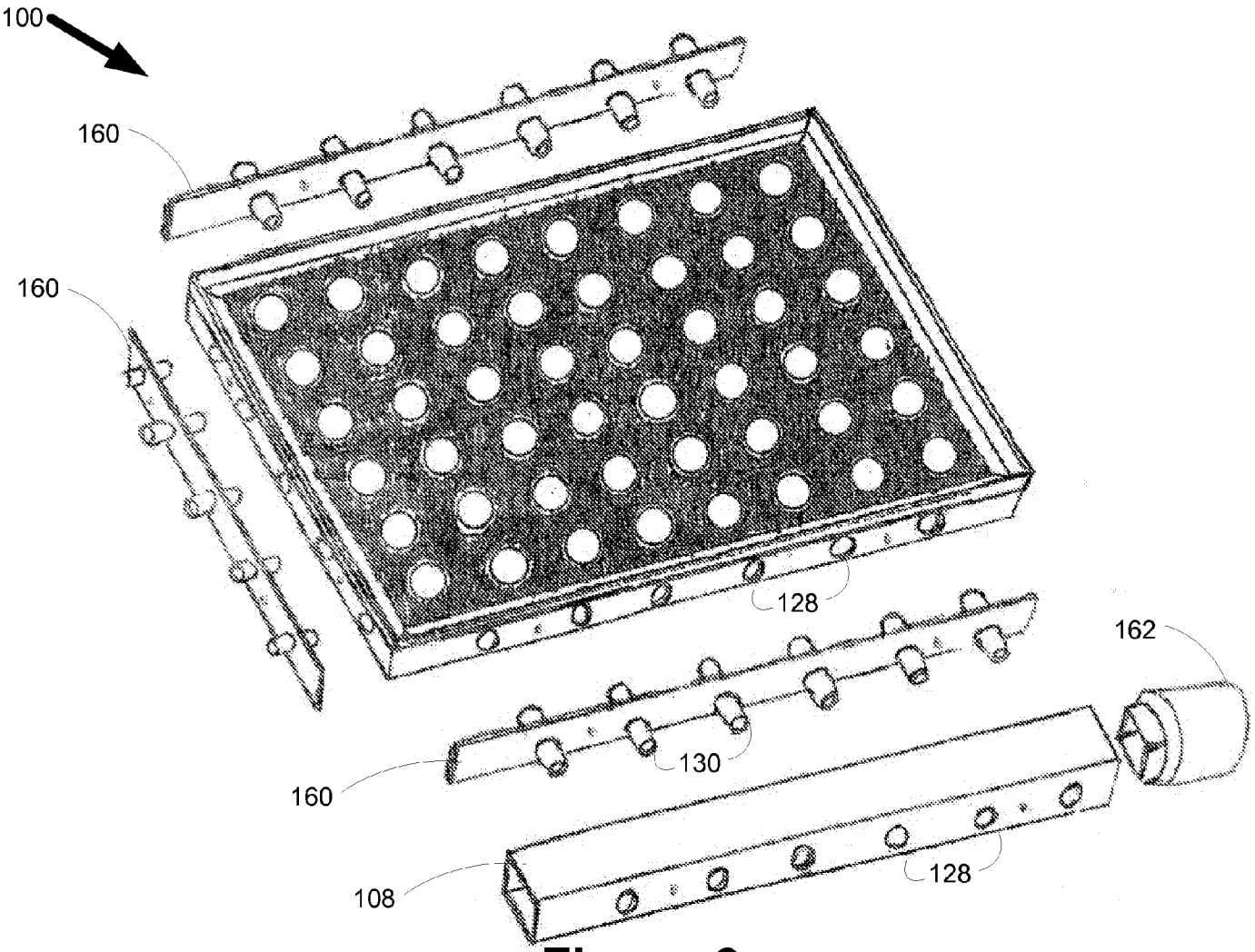
FIG. 6*m* is a perspective view diagram illustrating an example of how the apparatus can be implemented in a modular manner.

FIG. 6*k* is a perspective view diagram illustrating an example of a bottom view of a top plate 104 and a configuration of tension-protrusion assemblies 134 attached to the bottom surface of the top plate 104. As illustrated in the Figure, the tension-protrusion assemblies 134 are attached to the bottom surface of the top plate 104, not the top surface of the bottom plate 114. A spill barrier 150 is approximately ½" high. The apparatus 100 also includes an alignment peg 152 to facilitate peg location for modular embodiments of the apparatus 100. The tension-protrusion assemblies 133 are each comprised of two flat springs 134 and four hemispheres 132.

FIG. 6*l* is a plan view diagram illustrating an example of a cross section side view of a tension-protrusion assembly 133 that includes two hemispheres 132 attached to a single flat spring 134. A bolt 142 is used to connect the hemispheres 132 to the flat spring 132 in a configuration that includes two washers 144 and 146.

FIG. 6*m* is a perspective view diagram illustrating an example of how the apparatus 100 can be implemented in a modular manner. A mating connector 160 comprised of male mating connections 140 is used to connect the apparatus 100 to other apparatuses 100 or to an adapter 108. FIG. 6*m* also discloses an adapter attachment 162, with different attachments 162 being configured to interface with different vacuum devices.

Figure 6N:
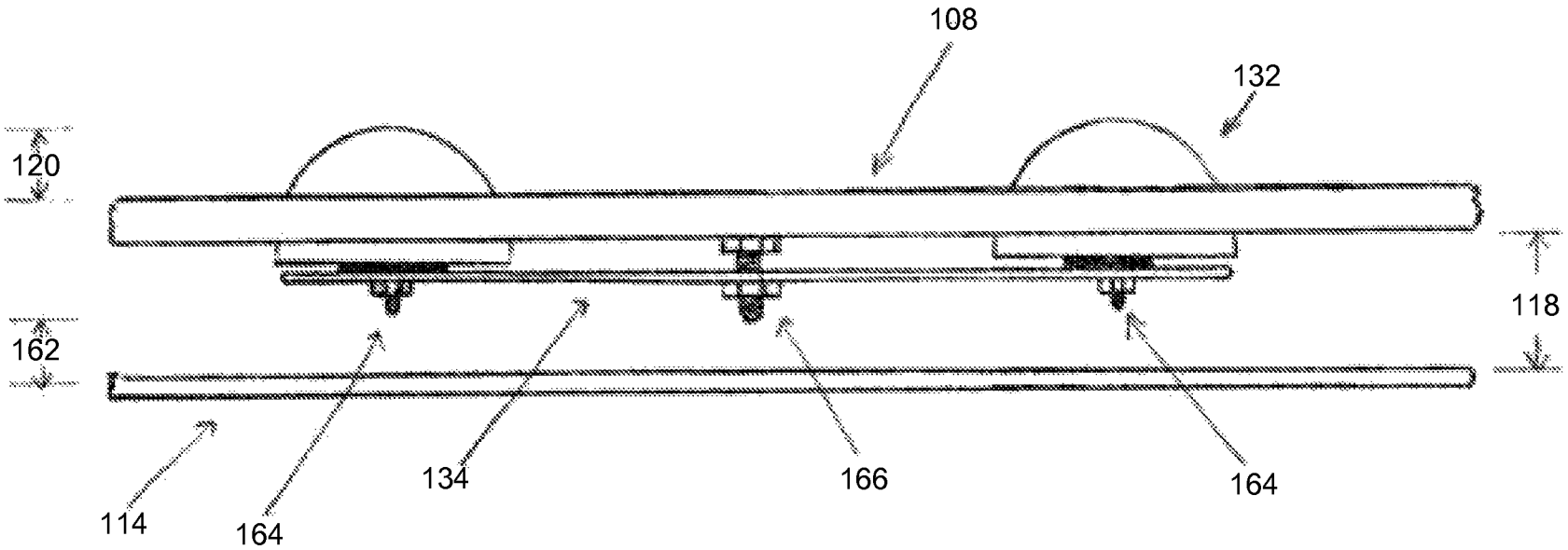
FIG. 6*n* is a plan view diagram illustrating an example of a cross section side view of a tension-protrusion assembly and its position with respect to a bottom plate in an unloaded state.
Figure 6O:
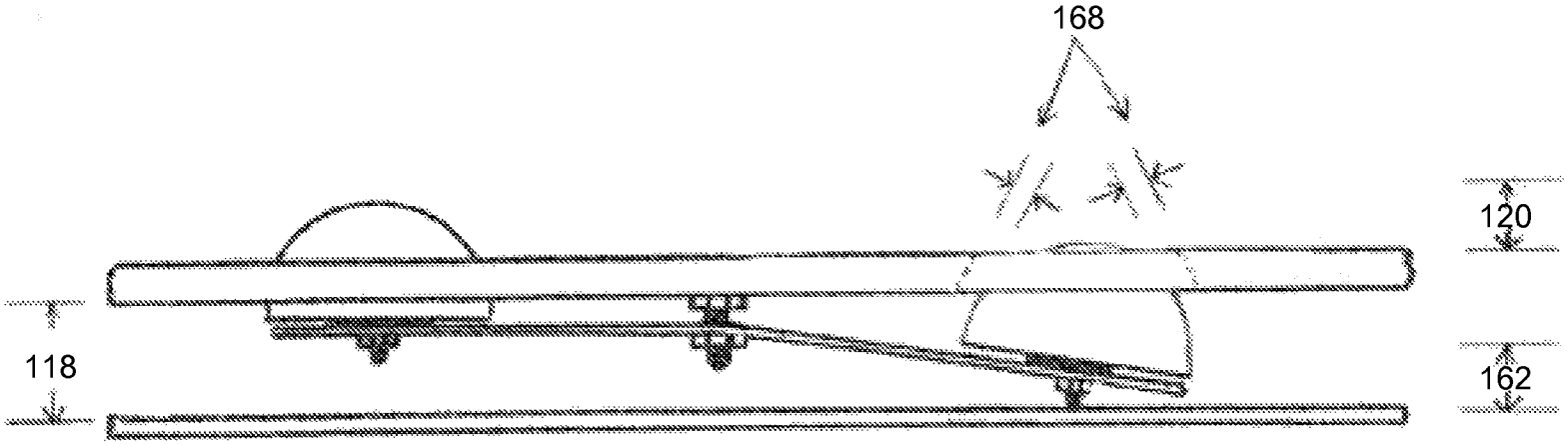
FIG. 6*o* is a plan view diagram similar to FIG. 6*n* except that the illustrated example includes a tension-protrusion assembly in a fully loaded state.
Figure 6R:
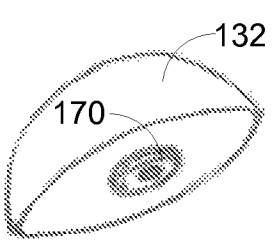
FIG. 6*r* is a perspective view diagram illustrating an example of a bottom perspective view of a hemisphere with an aluminum hex insert.

FIG. 6*n* is a plan view diagram illustrating an example of a cross section side view of a tension-protrusion assembly 133 and its position with respect to a bottom plate 114 in an unloaded state. FIG. 6*o* is the same assembly 133, where one hemisphere 132 is loaded. The distance 120 that the hemisphere 132 protrudes upwards approximately ⅜". The distance 118 between the plates is ¾". A captive nut 166 is used to adjust flat spring 134 tension. Screws 164 protruding from the bottom of the hemispheres 132 serve as a contact point of maximum movement of the hemispheres 132, with that distance 162 being equal to the distance between the bottom plate 114 to screw 164. FIG. 6*o* also illustrates an example of gaps 168 created by the depression of the hemispheres 132, FIG. 6*p* is a plan view diagram illustrating an example of a bottom view of a hemisphere 132 an aluminum hex insert 170.

Figure 6Q:
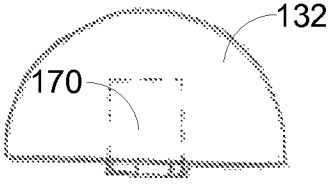
FIG. 6*q* is a plan view diagram illustrating an example of a cross section side view of a hemisphere with an aluminum hex insert.
Figure 6P:
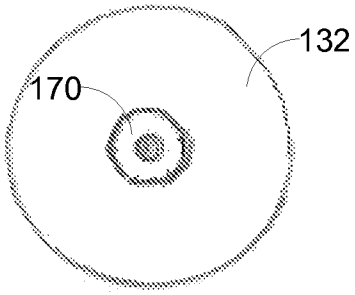
FIG. 6*p* is a plan view diagram illustrating an example of a bottom view of a hemisphere with an aluminum hex insert.

FIG. 6*q* is a plan view diagram illustrating an example of a cross section side view of a hemisphere 132 with an aluminum hex insert 170.

FIG. 6*r* is a perspective view diagram illustrating an example of a bottom perspective view of a hemisphere 132 with an aluminum hex insert 170.

VII. ALTERNATIVE EMBODIMENTS

In accordance with the provisions of the patent statutes, the principles and modes of operation of this invention have been explained and illustrated in preferred embodiments. However, it must be understood that this invention may be practiced otherwise than is specifically explained and illustrated without departing from its spirit or scope.

The invention claimed is:

1. An apparatus that provides for cleaning an exterior object temporarily positioned on top of the apparatus, said apparatus comprising:

a top plate, said top plate including a plurality of openings, wherein said openings are curved and at least substantially vertical, wherein said openings are larger at a bottom surface of said top plate than at a top surface of said top plate;

a bottom plate that provides for supporting said apparatus;

a first frame connected to said bottom plate and said top plate, wherein said first frame provides for supporting said top plate; and a plurality of tension-protrusion assemblies, wherein each of said plurality of tension-protrusion assemblies includes:

a plurality of tension components;

a plurality of protrusion components, wherein a top portion of said plurality of protrusion components are positioned above said top plate when the object is not on top of said protrusion components, and wherein a top portion of said of said plurality of protrusion components are positioned at height substantially equal to that of said top surface of said top plate when the protrusion components are in a compressed state; and a connector that connects a bottom portion of said tension-protrusion assembly to said bottom surface of said top plate;

wherein said connector is not positioned directly underneath any said opening in said top plate;

wherein said plurality of protrusion components are substantially hemisphere shaped;

wherein said plurality of openings are substantially circular;

wherein said plurality of openings include a top diameter that is small than a bottom diameter; and wherein each said tension-protrusion assembly includes more said protrusion components than said tension components.

2. The apparatus of claim 1, wherein each said tension-protrusion assembly is comprised of two said tension components and four said protrusion components.

3. The apparatus of claim 1, wherein placing the exterior object on said plurality of protrusion components causes a reduction in a vertical distance between said top plate and said bottom plate, wherein said top plate is supported by said first frame and not said bottom plate.

4. The apparatus of claim 1, further comprising a spill barrier having a height that is shorter than said plurality of protrusions, wherein said single connector never touches said bottom plate when said tension-protrusion assembly is fully loaded by the exterior object, and wherein said protrusion components never touch said bottom plate when said protrusion components are fully loaded by the exterior object.

5. The apparatus of claim 1, further comprising a rubber mat on top of said top plate, wherein said plurality of tension components do not come into direct contact with said bottom plate when a load is placed on said apparatus, wherein said plurality of protrusion components are comprised of polyethylene or silicon, wherein said plurality of protrusion components are in the shape of hemispheres.

6. The apparatus of claim 1, wherein each said tension-protrusion assembly includes two said tension components positioned into an X configuration.

7. The apparatus of claim 1, wherein said bottom plate and said top plate are comprised of aluminum and wherein each said tension component of the plurality of tension components includes a flat spring, and wherein the mass of said top plate is supported by said first frame when said apparatus is not loaded with the exterior object.

8. The apparatus of claim 1, said apparatus further comprising a mating connector that connects said first frame to a second frame.

9. The apparatus of claim 8, said first frame and said second frame including a plurality of substantially horizontal openings on more than one side of each said frame, wherein said mating connector is configured to connect said first frame to said second frame through said substantially horizontal openings.

10. The apparatus of claim 8, further comprising a vacuum hose adaptor connected to said second frame through said first frame.

11. The apparatus of claim 1, wherein each said tension-protrusion assembly has only one said connector.

12. The apparatus of claim 1, wherein said first frame provides for being removable from said bottom plate and said top plate, wherein said apparatus provides for cleaning with water as well as without water, and wherein said tension-protrusion assemblies provide for being removable from said bottom surface of said top plate.

13. The apparatus of claim 1, said first frame including a spill barrier to prevent debris or water from spilling outside said apparatus, wherein said first frame provides for supporting said top plate, and wherein the geometry of said first frame does not change when the exterior object is loaded to the apparatus and when the exterior object is removed from the apparatus.

14. The apparatus of claim 1, wherein said apparatus is embedded in a floor.

15. The apparatus of claim 1, wherein said apparatus is powered by a vacuum source.

16. An apparatus that provides for cleaning an exterior object temporarily positioned on top of the apparatus, said apparatus comprising:

a top plate, said top plate including a plurality of openings, wherein said openings are curved at least substantially vertical, wherein said openings are larger at a bottom surface of said top plate than at a top surface of said top plate;

a bottom plate that provides for supporting said apparatus;

a frame connected to said bottom plate and said top plate, wherein said frame provides for supporting said top plate;

a plurality of tension-protrusion assemblies, wherein each of said plurality of tension-protrusion assemblies includes:

a plurality of tension components, wherein;

a plurality of protrusion components, wherein a top portion of said plurality of protrusion components are positioned above said top plate when the object is not on top of said protrusion components, and wherein a top portion of said of said plurality of protrusion components are positioned at height substantially equal to that of said top surface of said top plate when the object is on top of said protrusion components; and a connector that connects a bottom portion of said tension-protrusion assembly to said bottom surface of said top plate;

wherein said connector is not positioned directly underneath any said opening in said top plate;

wherein said connector is positioned in a substantially centered manner with respect to a plurality of horizontal positions of said protrusion components which correspond to said openings;

wherein said bottom plate and said top plate are comprised of aluminum;

wherein each tension component of the plurality of tension components includes a flat spring; and where the mass of said top plates is supported by said frame when said apparatus is not loaded with the exterior object.

17. The apparatus of claim 16, said apparatus further comprising a vacuum adapter attached to said frame, wherein each said tension-protrusion assembly includes at least two said tension components and at least 4 said protrusions in an X-shaped configuration.

18. A network of modular vacuum-based cleaning apparatuses, comprising:

a plurality of apparatuses, each said apparatus including:

a bottom plate;

a top plate, said top plate including a plurality of substantially vertical openings and bottom surface;

a plurality of tension components positioned between said bottom plate and said top plate, wherein said tension components are connected to said bottom surface of said top plate, and wherein said tension components are also connected to a plurality of protrusion components;

said plurality of protrusion components attached to said plurality of tension components, wherein said protrusion components at least partially protrude upwards through said substantially vertical openings in said top plate; and a frame connected to said bottom plate and said top plate, wherein said top plate, said plurality of tension components, and said plurality of protrusion components are supported by said frame and not said bottom plate;

a connector providing to connect said plurality of apparatuses together in a substantially horizontal manner, wherein said apparatuses are connected to a single vacuum cleaner;

wherein said protrusion components and said tension components comprise a plurality of tension-protrusion assemblies, said tension-protrusion assemblies including a plurality of assembly connectors connecting said tension-protrusion assemblies to said bottom surface of said top plate, wherein each assembly connector of said plurality of assembly connectors connects to a respective X-shaped configuration of two said tension components wherein each x-shaped of configuration of two said tention components is connected to four said protrusion components.

* * * * *